US011238812B2

(12) United States Patent
Kempf

(10) Patent No.: US 11,238,812 B2
(45) Date of Patent: Feb. 1, 2022

(54) IMAGE MOTION MANAGEMENT

(71) Applicant: TEXAS INSTRUMENTS INCORPORATED, Dallas, TX (US)

(72) Inventor: Jeffrey Matthew Kempf, Dallas, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 16/285,282

(22) Filed: Feb. 26, 2019

(65) Prior Publication Data

US 2020/0105208 A1 Apr. 2, 2020

Related U.S. Application Data

(60) Provisional application No. 62/739,936, filed on Oct. 2, 2018.

(51) Int. Cl.
*G09G 3/34* (2006.01)

(52) U.S. Cl.
CPC ..... *G09G 3/34* (2013.01); *G09G 2310/08* (2013.01); *G09G 2320/0261* (2013.01); *G09G 2320/0626* (2013.01)

(58) Field of Classification Search
None
See application file for complete search history.

(56) References Cited

U.S. PATENT DOCUMENTS

| | | | | |
|---|---|---|---|---|
| 6,693,609 | B2 * | 2/2004 | Lee | G09G 3/2059 345/63 |
| 7,460,132 | B2 * | 12/2008 | Kempf | G09G 3/2092 345/428 |
| 8,085,230 | B2 * | 12/2011 | Kim | G09G 3/3648 345/89 |
| 9,230,296 | B2 | 1/2016 | Clatanoff et al. | |
| 2002/0126313 | A1 * | 9/2002 | Namizuka | H04N 1/4092 358/2.1 |
| 2002/0135585 | A1 * | 9/2002 | Dye | G09G 5/363 345/531 |
| 2003/0006952 | A1 * | 1/2003 | Hong | G09G 3/3648 345/89 |
| 2003/0011614 | A1 * | 1/2003 | Itoh | G09G 3/3648 345/589 |
| 2003/0156301 | A1 * | 8/2003 | Kempf | H04N 7/012 358/486 |
| 2004/0155894 | A1 * | 8/2004 | Van Dijk | G09G 3/2007 345/692 |

(Continued)

*Primary Examiner* — Dorothy Harris
(74) *Attorney, Agent, or Firm* — Michelle F. Murray; Charles A. Brill; Frank D. Cimino

(57) ABSTRACT

A method for managing motion includes dividing a time allocated to display of an image into a first interval and a second interval. The second interval is immediately subsequent to the first interval. An amount of light energy to be emitted at a pixel during the time is determined based on the image. A first portion of the light energy is generated at the pixel in the first interval. The first portion comprises as much of the light energy as is generatable in the first interval. A second portion of the light energy is generated at the pixel in the second interval based on the light energy generatable in the first interval being less than the amount of light energy to be emitted at the pixel during the time.

20 Claims, 5 Drawing Sheets

(56) References Cited

U.S. PATENT DOCUMENTS

| | | | | |
|---|---|---|---|---|
| 2004/0239669 | A1* | 12/2004 | Doyen | G09G 3/2033 345/418 |
| 2005/0162360 | A1* | 7/2005 | Ishihara | G09G 3/2081 345/89 |
| 2006/0145992 | A1* | 7/2006 | Hsieh | G09G 3/3611 345/94 |
| 2006/0221008 | A1* | 10/2006 | Seki | G09G 3/2044 345/76 |
| 2006/0244759 | A1* | 11/2006 | Kempf | G09G 3/2092 345/611 |
| 2008/0211749 | A1* | 9/2008 | Weitbruch | G09G 3/3233 345/77 |
| 2008/0309683 | A1* | 12/2008 | Kim | G09G 3/2092 345/690 |
| 2009/0009509 | A1* | 1/2009 | Tagami | G09G 3/2022 345/214 |
| 2012/0098738 | A1* | 4/2012 | Yoshida | G09G 3/3611 345/102 |

* cited by examiner

IMAGE MOTION MANAGEMENT

CROSS-REFERENCE TO RELATED APPLICATIONS

The present application claims priority to U.S. Provisional Patent Application No. 62/739,936, filed Oct. 2, 2018, entitled "Microsecond Motion Management," which is hereby incorporated herein by reference in its entirety.

BACKGROUND

Many image display systems utilize spatial light modulators (SLMs). SLMs comprise arrays of individually addressable and controllable pixel elements that modulate light according to input data streams corresponding to image frame pixel data.

Digital micromirror devices (DMDs) are a type of SLM, and may be used for either direct-view or projection display applications. A DMD has an array of micromechanical pixel elements, each having a tiny mirror that is individually addressable by an electrical signal. Depending on the state of its addressing signal, each mirror element tilts so that it either does or does not reflect light to the image plane. Other SLMs operate on similar principles, with arrays of pixel elements that may emit or reflect light simultaneously with other pixel elements, such that a complete image is generated by sequences of addressing the pixel elements. Other examples of an SLM include a liquid crystal display (LCD) or a liquid crystal on silicon (LCOS) display which have individually driven pixel elements. Typically, displaying each frame of pixel data is accomplished by loading memory cells so that pixel elements can be simultaneously addressed.

In some SLM display systems, pulse-width modulation (PWM) techniques are used to achieve intermediate levels of illumination, between white (ON) and black (OFF), corresponding to gray levels of intensity. The viewer's eye integrates the pixel brightness so that the image appears the same as if it were generated with analog levels of light.

SUMMARY

A motion management method and a motion management system that implements the method are disclosed herein. The method reduces motion blur in electronic displays that employ pulse width modulation. In one example, a display controller includes a motion management system. The motion management system is configured to divide a time allocated to display of an image into a first interval and a second interval. The second interval is immediately subsequent to the first interval. The motion management system is also configured to determine, based on the image, an amount of light energy to be emitted at a pixel during the time. The motion management system is further configured to generate, at the pixel, a first portion of the light energy in the first interval, wherein the first portion comprises as much of the light energy as is generatable in the first interval. The motion management system is yet further configured to generate, at the pixel, a second portion of the light energy in the second interval based on the light energy generatable in the first interval being less than the amount of light energy to be emitted at a pixel during the time.

In another example, a display controller includes a motion management system. The motion management system is configured to display an image as a first sub-frame and a second sub-frame that is spatially offset from the first sub-frame. The motion management system is also configured to determine, based on the image, a total amount of light energy to be emitted at a pixel in the first sub-frame and the second sub-frame. The motion management system is further configured to generate, at the pixel, a first portion of the total amount of light energy in the first sub-frame. The first portion comprises as much of the total amount of light energy as is generatable in the first sub-frame. The motion management system is yet further configured to generate, at the pixel, a second portion of the total amount of light energy in the second sub-frame based on the light energy generatable in the first sub-frame being less than the total amount of light energy to be emitted at the pixel in the first sub-frame and the second sub-frame.

In a further example, a method for managing motion includes dividing a time allocated to display of an image into a first interval and a second interval. The second interval is immediately subsequent to the first interval. An amount of light energy to be emitted at a pixel during the time is determined based on the image. A first portion of the light energy is generated at the pixel in the first interval. The first portion comprises as much of the light energy as is generatable in the first interval. A second portion of the light energy is generated at the pixel in the second interval based on the light energy generatable in the first interval being less than the amount of light energy to be emitted at a pixel during the time.

BRIEF DESCRIPTION OF THE DRAWINGS

For a detailed description of various examples, reference will now be made to the accompanying drawings in which.

DETAILED DESCRIPTION

Figure 1:
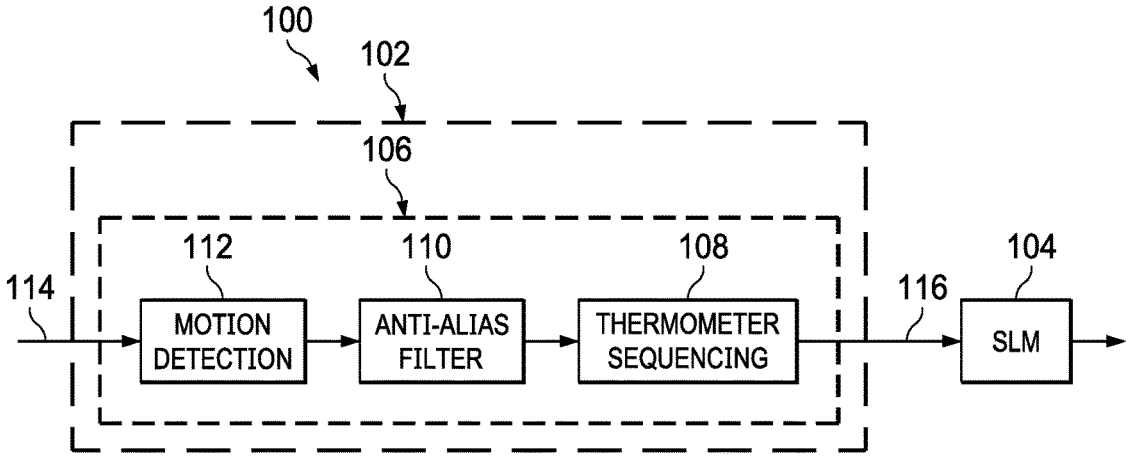
FIG. 1 shows a block diagram for an example display system that includes motion management in accordance with this description.

In this description, the term "couple" or "couples" means either an indirect or direct wired or wireless connection.

Thus, if a first device couples to a second device, that connection may be through a direct connection or through an indirect connection via other devices and connections. Also, in this description, the recitation "based on" means "based at least in part on." Therefore, if X is based on Y, then X may be a function of Y and any number of other factors.

Some spatial light modulation (SLM) systems (e.g., digital mirror device (DMD) systems) employ a pulse width modulation (PWM) scheme to produce gray shades between black and white. That is, shades are produced by varying the percentage of time that a micromirror (or other light control element) directs light through (or away from) the projection optics. An input pixel that is at a brightness level of 25% will result in a micromirror directing light through the projection optics for 25% of the input frame period. This process assumes that an observer will time integrate PWM patterns along a fixed spatial position. This assumption is violated if objects in the displayed images are in motion. When viewing a moving object on an electronic display, the observer will track the object's position, which keeps the moving object in a relatively fixed position on the viewer's retina. Hence, the observer time integrates pixel data along the object's motion trajectory. If the motion between input frames is relatively large, integration errors will be apparent in a PWM-based electronic display, and will manifest as blurring or a loss of resolution for moving objects.

Some SLM systems employ motion estimation/motion compensation (MEMC) to reduce motion related blurring. MEMC estimates the motion of objects in an image by analyzing the inter-frame change in position of the objects. MEMC increases the frame rate of the displayed images, and inserts additional frames that reposition the objects based on the estimated motion. Analysis of object motion and generation of additional images can be computationally complex and, as result, implementation of MEMC can be costly.

The video processing systems disclosed herein reduce motion blur for displays produced using spatial light modulators, such as DMD, that employ PWM without implementation of costly MEMC circuitry. The video processing systems disclosed herein employ PWM to concentrate light energy at the beginning of a frame, which reduces motion blurring. For example, if the video processing system divides the frame display time into four successive intervals, then the light generated at each pixel of the display is divided across the four intervals. The video processing system determines the total amount of light energy to be provided at a pixel during the frame and concentrates generation of the light energy in the earlier intervals. If the total amount of light energy to be generated at the pixel in the frame is 25% or less of the light energy generatable at the pixel over the four intervals of the frame, then the video processing system generates all of the needed light energy at the pixel during the first interval of the frame. Similarly, if the total amount of light energy to be generated at the pixel in the frame is greater than 25% of the light energy generatable at the pixel over the four intervals of the frame, then the video processing system generates as much as possible of the needed light energy at the pixel during the first interval of the frame, and concentrates the remaining light energy in the $2^{nd}$-$4^{th}$ intervals such that the total needed light energy is generated as early as possible within the frame.

Some DMD control systems optically shift the DMD by a fraction of a pixel one or more times per input frame, and a high-resolution image is rendered from the integration of all spatially shifted DMD images. As with the PWM assumption described previously, this process relies upon time integration along a fixed spatial position, so motion violates this assumption. The video processing systems disclosed herein reduce motion blurring in displays that apply optical shifting to increase display resolution. For example, if the video processing system divides a frame into four spatially offset sub-frames, then the light generated at each pixel of the display is divided across the four sub-frames. The video processing system determines the total amount of light energy to be provided at a pixel during the four sub-frames and concentrates generation of the light energy in the earlier displayed sub-frames. If the total amount of light energy to be generated at the pixel in the four sub-frames is 25% or less of the light energy generatable at the pixel over the four sub-frames, then the video processing system generates all of the needed light energy at the pixel during the first sub-frame. Similarly, if the total amount of light energy to be generated at the pixel in the frame is greater than 25% the light energy generatable at the pixel over the four sub-frames, then the video processing system generates as much as possible of the needed light energy at the pixel during the first sub-frame, and concentrates the remaining light energy in the $2^{nd}$-$4^{th}$ sub-frames such that the total needed light energy is generated as early as possible within the four sub-frames.

FIG. 1 shows a block diagram for an example display system 100 that includes motion management in accordance with this description. The display system 100 includes a display controller 102 and a spatial light modulator (SLM) 104. The SLM 104 may be a digital micromirror device (DMD), a liquid crystal display (LCD), a liquid crystal on silicon (LCOS) display or other spatial light modulator used to generate a visual display. The display controller 102 receives images 114 and generates control signals 116 to control the light modulation elements (pixels) of the SLM 104 and generate a display of the received images 114. For example, where the SLM 104 is a DMD, the control signals 116 may control the positioning each micromirror of the SLM 104.

The display controller 102 includes a motion management system 106. The motion management system 106 identifies motion in the images 114 and generates the control signals 116 to reduce motion-related blurring in the displays produced by the SLM 104. The motion management system 106 includes thermometer sequencing circuitry 108, anti-alias filter circuitry 110, and motion detection circuitry 112. The thermometer sequencing circuitry 112 divides the time allocated to display of an image into multiple intervals, and concentrates the generation of light energy in pixels of the SLM 104 in the earlier intervals, which reduces motion induced blurring. For example, if the SLM 104 is a DMD, then the thermometer sequencing circuitry 108 divides the time allocated to display an image into multiple intervals (e.g., four intervals). Within each of the intervals, a pixel of the SLM 104 may reflect red, green, and blue light for a time selected by the thermometer sequencing circuitry 108 to create a desired color at the pixel. The time assigned to reflection of red, green, and blue light varies as needed via PWM to create the desired color and brightness at the pixel. In an implementation of the display controller 102 that lacks the motion management system 106, the display controller 102 may generate the control signals 116 to provide the same control in each of the multiple intervals (i.e., to generate the same light color and intensity at the pixel in each interval). In contrast, the thermometer sequencing circuitry 108 concentrates, in as few intervals as possible, the total amount of light energy desired at the pixel in frame time.

Figure 2A:
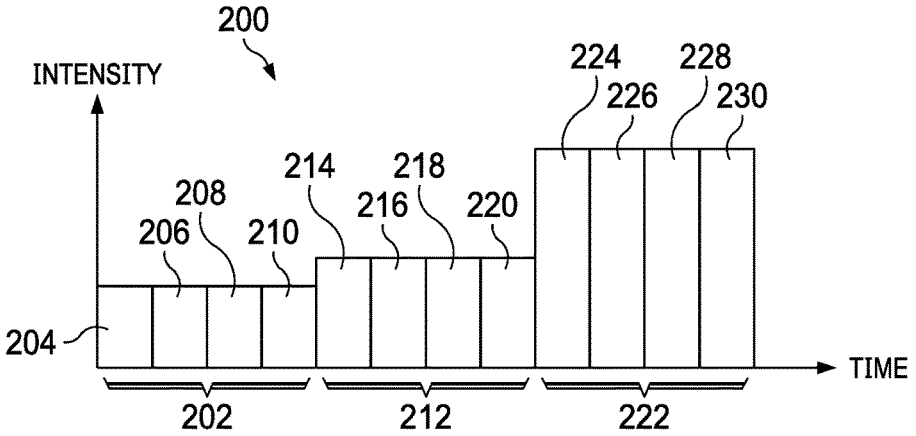
FIG. 2A shows an example of light generation at a pixel in a display system that lacks motion management in accordance with this description.
Figure 2B:
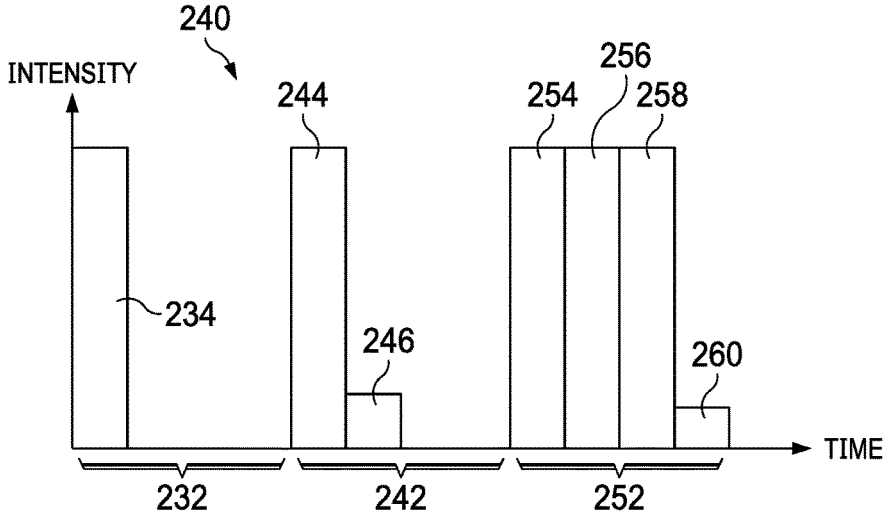
FIG. 2B shows an example of light generation at a pixel in a display system that includes motion management in accordance with this description.

FIGS. 2A and 2B illustrate the difference in light generation at a pixel using a display controller that lacks the motion management system 106 and using the display controller 102. FIG. 2A shows an example of light generation at a pixel using a display controller that lacks the motion management system 106. FIG. 2A shows display of three images at a pixel of the SLM 104. A first image is displayed in frame time 202, a second image is displayed in frame time frame time 212, and a third image is displayed in frame time frame time 222. Each of the frame time 202, the frame time 212, and the frame time 222 is divided into four successive intervals. The frame time 202 is divided into successive intervals 204, 206, 208, and 210. The frame time 212 is divided into successive intervals 214, 216, 218, and 220. The frame time 222 is divided into successive intervals 224, 226, 228, and 230. Each of the intervals of each frame time may be further sub-divided to red, green, and blue sub-intervals. In each of the interval 204, interval 206, interval 208, and interval 210, the display controller causes the SLM 104 to generate the same light color and intensity. In the frame time 212, the intensity of light generated is higher than the intensity of light generated in the frame time 202. In the interval 214, interval 216, interval 218, and interval 220 the display controller causes the SLM 104 to generate the same light color and intensity. In the frame time 222, the intensity of light generated is higher than the intensity of light generated in the frame time 212. In the interval 224, interval 226, interval 228, and interval 230 the display controller causes the SLM 104 to generate the same light color and intensity.

FIG. 2B shows an example of light generation at a pixel using the display controller 102. The intensity of light generated at a pixel in FIG. 2B corresponds to the intensity of light generated at the pixel in FIG. 2A. The thermometer sequencing circuitry 108 concentrates light generation in the earlier intervals of each frame time. In the frame time 232, the thermometer sequencing circuitry 108 has determined based on the image to be displayed during the frame time 232, the total amount of light energy to be emitted at the pixel. For example, the total amount of light energy to be emitted at the pixel in the frame time 232 is the sum of the light energy emitted in the intervals 204-210 in the frame time 202 of FIG. 2A. Based on the total amount of light energy to be emitted at the pixel in the frame time, the thermometer sequencing circuitry 108 determines the amount of light energy to be emitted at the pixel in each interval of the frame time. In the frame time 232, the thermometer sequencing circuitry 108 determines that the total amount of light energy to be emitted (e.g., the total amount of light energy emitted in the frame time frame time 202) can be produced in the interval 234 (i.e., the first interval of the frame time frame time 232). No light energy is emitted at the pixel in the intervals of the frame time 232 successive to the interval 234. Thus, the thermometer sequencing circuitry 108 concentrates the generation of light energy at the pixel at the start of the frame time 232.

In the frame time 242, the thermometer sequencing circuitry 108 determines that the total amount of light energy to be emitted (e.g., the total amount of light energy emitted in the frame time 212) is too great to be produced only in the interval 244 (i.e., the first interval of the frame time 242). The thermometer sequencing circuitry 108 generates at the pixel a maximum amount of light energy that can be generated in the interval 244, and generates the remainder of the total amount of light energy to be produced in the interval 246. No light energy is emitted at the pixel in the intervals of the frame time 242 successive to the interval 246. Thus, the thermometer sequencing circuitry 108 concentrates the generation of light energy at the pixel at the start of the frame time 242.

In the frame time 252, the thermometer sequencing circuitry 108 determines that the total amount of light energy to be emitted (e.g., the total amount of light energy emitted in the frame time frame time 222) requires that some light energy be produced in each interval of the frame time. The thermometer sequencing circuitry 108 generates at the pixel a maximum amount of light energy that can be generated in the intervals 254, 256, and 258, and generates the remainder of the total amount of light energy to be produced in the interval 260. Thus, the thermometer sequencing circuitry 108 concentrates the generation of light energy at the pixel at the start of the frame time 252.

The thermometer sequencing circuitry 108 effectively reduces the blurring caused by motion in the images 114. However, operation of the thermometer sequencing circuitry 108 on bright, high-frequency content of an image may induce aliasing artifacts in the displayed image. To reduce the effects of aliasing, the motion management system 106 identifies bright moving areas of the images 114, and applies an anti-alias filter to the identified areas of the images 114. The motion detection circuitry 112 identifies moving areas of the images 114. For example, the motion detection circuitry 112 identifies the areas (e.g., pixels) of each image 114 that have changed location with respect to a previous image (to an immediately previous image 114).

The anti-alias filter circuitry 110 applies an anti-alias filter (i.e., a low-pass filter) to the moving areas of the images 114 identified by the motion detection circuitry 112. In some implementations, the filtering is a function of a measure of brightness and/or a measure of motion of the areas identified by the motion detection circuitry 112. For example, the amount of filtering performed (e.g., degree of high-frequency attenuation) may be a function of measured brightness and/or measured motion. In some implementations of the anti-alias filter circuitry 110, filtering is applied to areas of the image that are identified as moving by the motion detection circuitry 112 and that have a brightness exceeding a predetermined brightness threshold.

Figure 3:
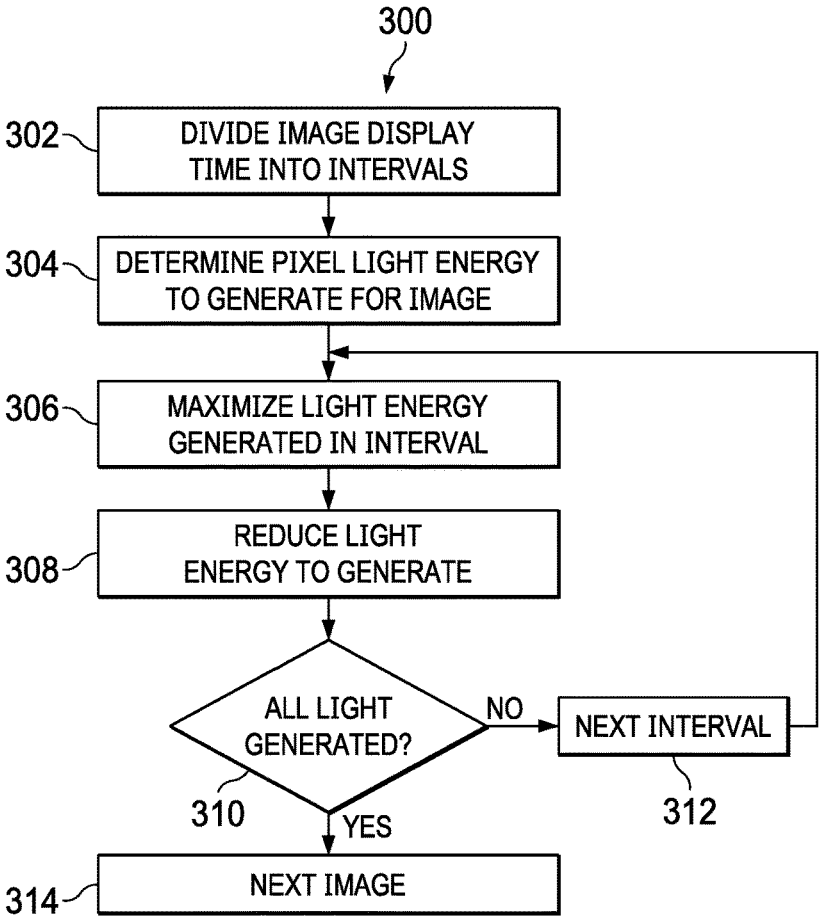
FIG. 3 shows a flow diagram for an example method for motion management in accordance with this description.

FIG. 3 shows a flow diagram for an example method 300 for motion management in accordance with this description. Though depicted sequentially as a matter of convenience, at least some of the actions shown can be performed in a different order and/or performed in parallel. Additionally, some implementations may perform only some of the actions shown. Operations of the method 300 may be performed by implementations of the display controller 102.

In block 302, the display controller 102 divides the time allocated to display of an image into multiple successive intervals. For example, in FIG. 2B, the display controller 102 divides the frame time 232 in four intervals.

In block 304, the display controller 102 determines the total light energy to be generated at a pixel in the time allocated to display of the image (i.e., frame time). For example, the display controller 102 determines the total light energy to be generated at a pixel in the frame time 232.

In block 306, the display controller 102 maximizes the light energy generated at the pixel in the current interval. For example, in frame time 232 all of the light energy to be generated is generatable in a single interval, and the display controller 102 generates all of the light energy at the pixel in the interval 234.

In block 308, the display controller 102 determines the amount of remaining light energy to be generated at the pixel in the allocated time. For example, the display controller 102 determines the total amount of light energy to be generated in the frame time less the amount of light energy generated in previous iterations of the block 306.

In block 310, the display controller 102 determines whether the total amount of light energy to be generated at the pixel in the frame time has been generated. For example, in frame time 242 the display controller 102 generates light energy at the pixel in the interval 244 and determines that additional light energy is to be generated in the interval 246.

If all the desired light energy has not been generated, then in block 312, the display controller 102 proceeds to generate additional light in the next interval of the frame time. For example, in interval 246 the display controller 102 generates the remainder of the light energy to be produced in the frame time 242. If all the desired light energy has been generated, then the display controller 102 proceeds to process the next image 114 in block 314.

Figure 4:
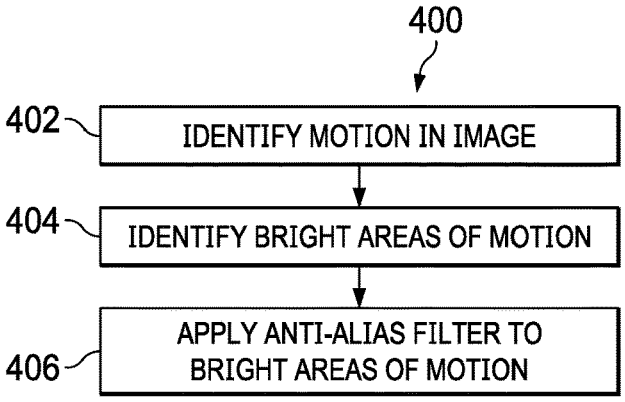
FIG. 4 shows a flow diagram for an example method for reducing aliasing artifacts in an image in accordance with this description.

FIG. 4 shows a flow diagram for an example method 400 for reducing aliasing artifacts in an image in accordance with this description. Though depicted sequentially as a matter of convenience, at least some of the actions shown can be performed in a different order and/or performed in parallel. Additionally, some implementations may perform only some of the actions shown. Operations of the 400 may be performed by implementations of the display controller 102.

In block 402, the display controller 102 identifies areas of an images 114 that are moving. For example, the display controller 102 identifies pixels associated with an object in the images 114 that have changed location relative to a previous image 114.

In block 404, the display controller 102 identifies brightness of the areas identified as moving in block 404.

In block 406, the display controller 102 applies anti-alias filtering to the bright moving areas identified in blocks 402 and 404. In some implementations, the amount of filtering is dependent on the brightness of the moving area. For example, the brighter the moving area, the greater the high-frequency attenuation applied to the area.

Figure 5:
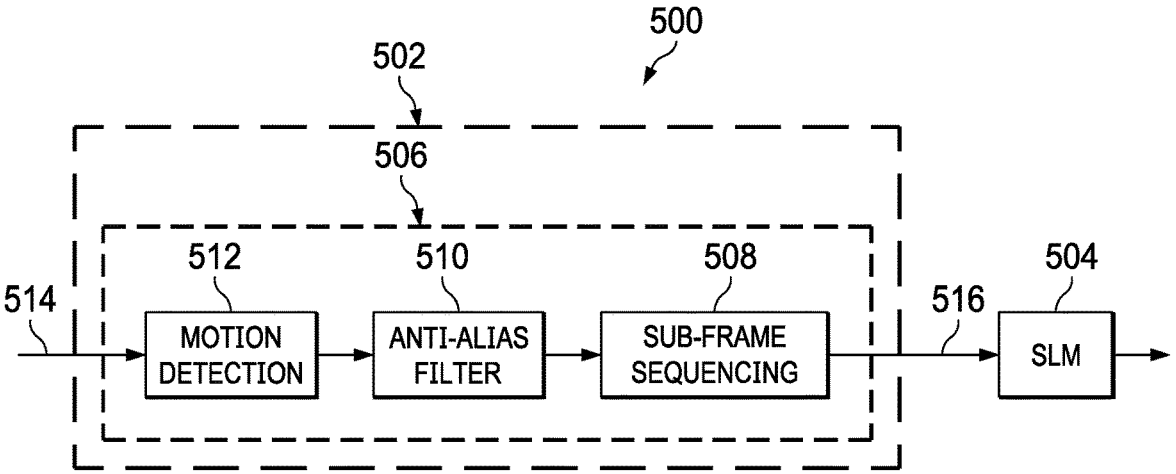
FIG. 5 shows a block diagram for an example display system that applies optical shifting to increase display resolution and includes motion management in accordance with this description.

FIG. 5 shows a block diagram for an example display system 500 that applies optical shifting to increase display resolution and includes motion management in accordance with this description. The display system 500 includes a display controller 502 and a spatial light modulator (SLM) 504. The SLM 504 may be a digital micromirror device (DMD), a liquid crystal display (LCD), a liquid crystal on silicon (LCOS) display or other spatial light modulator used to generate a visual display. The display controller 502 receives images 514 and generates control signals 516 to control the light modulation elements (pixels) of the SLM 504 and generate a display of the received images 514. For example, where the SLM 504 is a DMD, the control signals 516 may control the positioning each micromirror of the SLM 104.

Figure 6:
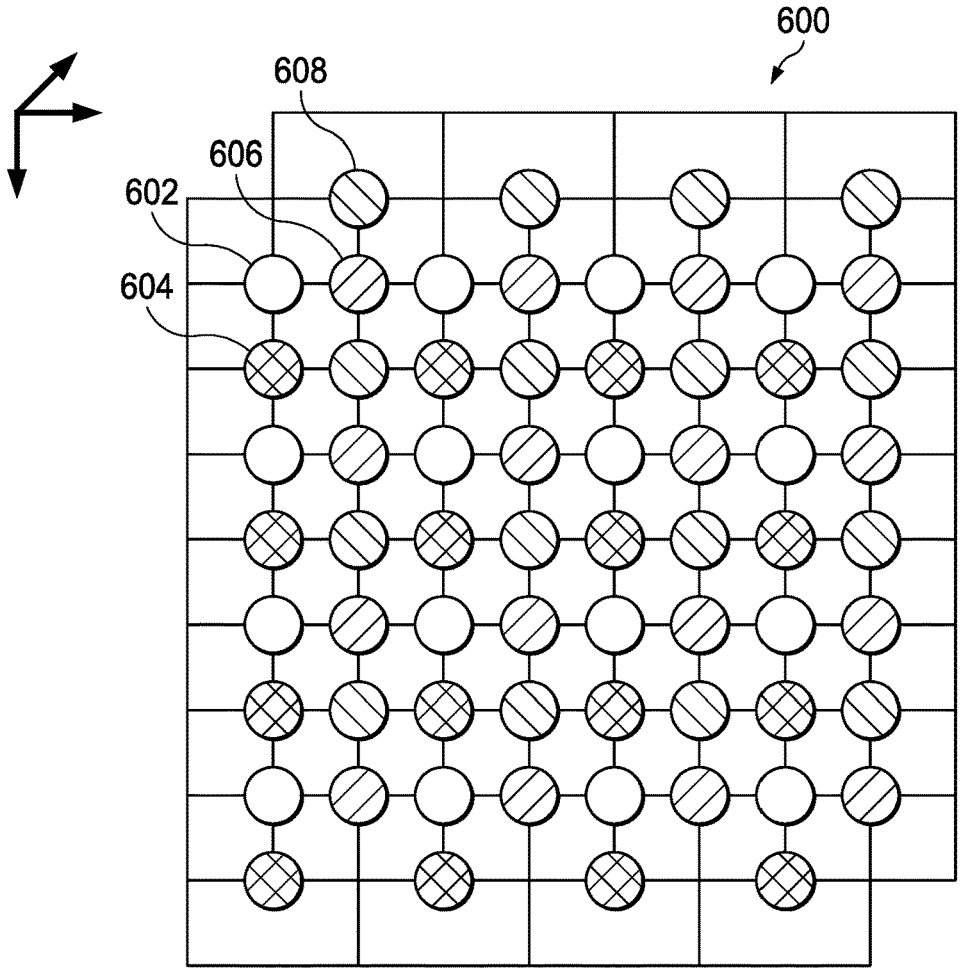
FIG. 6 shows an example of optical shifting to increase display resolution.

The display system 500 applies optical dithering to increase the resolution of the display generated by the SLM 504. For example, the display system 500 may optically reposition the output of the SLM 504 in a number half-pixel steps to increase display resolution. FIG. 6 shows pixels generated by shifting the output of the SLM 504 three times to generate a display that is four times the resolution of the SLM 504. The pixels 602 represent the unshifted pixels displayed by the SLM 504. The pixels 604 represent the pixels of the SLM 504 shifted vertically by one-half pixel. The pixels 606 represent the pixels of the SLM 504 shifted horizontally by one-half pixel. The pixels 608 represent the pixels of the SLM 504 shifted vertically and horizontally by one-half pixel. To generate the high-resolution display 600, the display controller 502 generates each pixel set of the high-resolution display 600 as a different sub-frame (one of four sub-frames in FIG. 6). For example, a frame time is divided in four sub-frames. The pixels 602 are displayed in a first sub-frame. The pixels 604 are displayed in a second sub-frame. The pixels 606 are displayed in a third sub-frame. The pixels 608 are displayed in a fourth sub-frame. For each sub-frame, output of the SLM 504 is optically shifted to the desired pixel location.

The display controller 502 includes a motion management system 506. The motion management system 506 identifies motion in the images 514 and generates the control signals 516 to reduce motion-related blurring in the displays produced by the SLM 504. The motion management system 506 includes sub-frame sequencing circuitry 508, anti-alias filter circuitry 510, and motion detection circuitry 512. The sub-frame sequencing circuitry 508 divides the time allocated to display of an image (frame time) into multiple sub-frames, and concentrates the generation of light energy in pixels of the SLM 104 in the earlier sub-frames, which reduces motion induced blurring. For example, if the SLM 104 is a DMD, then the sub-frame sequencing circuitry 508 divides the frame time allocated to display an image into multiple sub-frames (e.g., four sub-frames). Within each of the sub-frames, a pixel of the SLM 104 may reflect red, green, and blue light for a time selected by the sub-frame sequencing circuitry 508 to create a desired color at the pixel. The time assigned to reflection of red, green, and blue light varies as needed to create the desired color at the pixel. To reduce motion related blurring, the sub-frame sequencing circuitry 508 concentrates, in as few sub-frames as possible, the total amount of light energy that would be generated at the pixel in all of the sub-frames generated using the pixel.

Figure 7A:
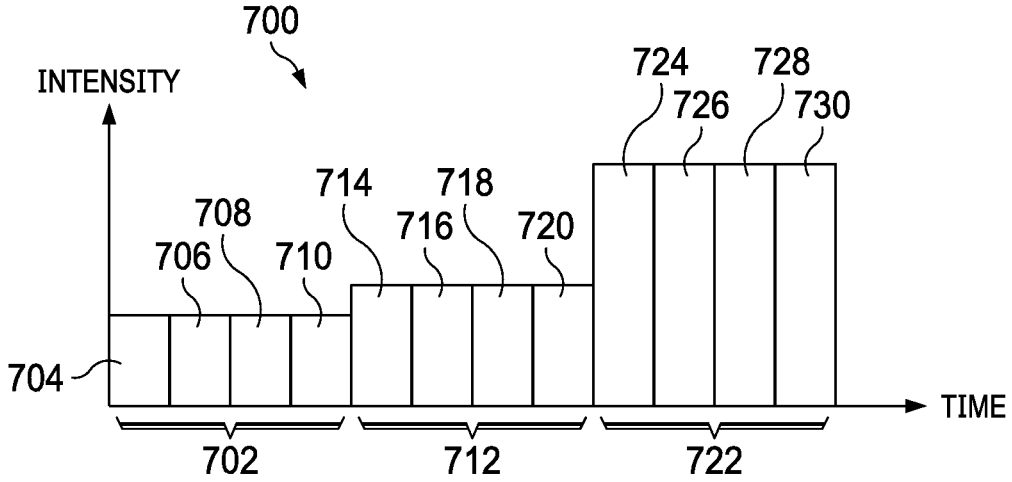
FIG. 7A shows an example of light generation at a pixel in a display system that applies optical shifting to increase display resolution and lacks motion management in accordance with this description.
Figure 7B:
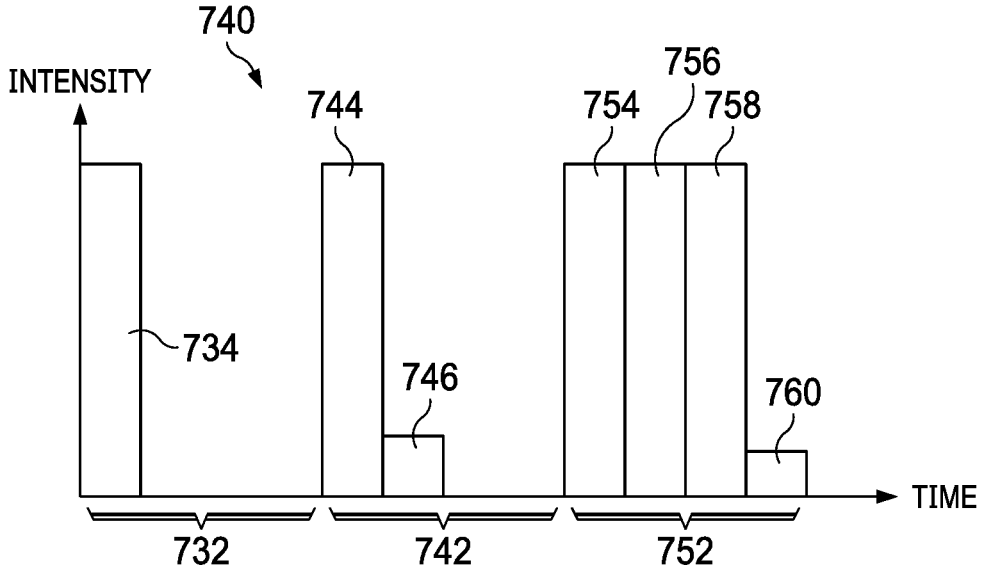
FIG. 7B shows an example of light generation at a pixel in a display system that applies optical shifting to increase display resolution and includes motion management in accordance with this description.

FIGS. 7A and 7B illustrate the difference in light generation at a pixel using a display controller that lacks the motion management system 506 and using the display controller 502. FIG. 7A shows an example of light generation at a pixel using a display controller that lacks the motion management system 506. FIG. 7A shows display of three images at a pixel of the SLM 504. A first image is displayed in frame time 702, a second image is displayed in frame time 712, and a third image is displayed in frame time 722. Each of the frame time 702, the frame time 712, and the frame time 722 is divided into four sub-frames. The frame time 702 is divided into sub-frames 704, 706, 708, and 710. The frame time 712 is divided into sub-frames 714, 716, 718, and 720. The frame time 722 is divided into sub-frames 724, 726, 728, and 730. Each of the sub-frames may be further sub-divided into red, green, and blue light generation intervals. In each of the sub-frames 704, 706, 708, and 710, the display controller causes the SLM 504 to generate light of generally the same color and intensity in accordance with the sub-frame images displayed. For example, different sub-frame images may be generated by down-sampling a higher resolution image. In the frame time 712, the intensity of light generated is higher than the intensity of light generated in the frame time 702. In the sub-frames 714, 716, 718, and 720 the display controller causes the SLM 504 to generate light of generally the same color and intensity in accordance with the sub-frame images displayed. In the frame time 722, the intensity of light generated is higher than the intensity of light generated in the frame time 712. In the sub-frames 724, 726, 728, and 730 the display controller causes the SLM 104 to generate light of generally the same color and intensity in accordance with the sub-frame images displayed.

FIG. 7B shows an example of light generation at a pixel of the SLM 504 using the display controller 502. The light generated at a pixel in FIG. 7B corresponds to the light generated at the pixel in FIG. 2A. The sub-frame sequencing circuitry 508 concentrates light generation in the earlier sub-frames of each frame time. In the frame time 732, the sub-frame sequencing circuitry 508 has determined based on the sub-frame images to be displayed during the frame time 732, the total amount of light energy to be emitted at the pixel. For example, the total amount of light energy to be emitted at the pixel in the frame time 732 is the sum of the light energy emitted at the pixel in the sub-frames 704-710 of the frame time 702 of FIG. 7A. Based on the total amount of light energy to be emitted at the pixel in the frame time, the sub-frame sequencing circuitry 508 determines the amount of light energy to be emitted at the pixel in each sub-frame of the frame time. In the frame time 732, the sub-frame sequencing circuitry 508 determines that the total amount of light energy to be emitted (e.g., the total amount of light energy emitted in the frame time 702) can be produced in the sub-frame 734 (i.e., the first sub-frame of the frame time 732). No light energy is emitted at the pixel in the sub-frames of the frame time 732 successive to the sub-frame 734. Thus, the sub-frame sequencing circuitry 508 concentrates the generation of light energy at the pixel at the start of the frame time 732.

In the frame time 742, the sub-frame sequencing circuitry 508 determines that the total amount of light energy to be emitted (e.g., the total amount of light energy emitted in the frame time 712) is too great to be produced solely in the sub-frame 744 (i.e., the first sub-frame of the frame time 742). The sub-frame sequencing circuitry 508 generates at the pixel a maximum amount of light energy that can be generated in the sub-frame 744, and generates the remainder of the total amount of light energy to be produced in the sub-frame 746. No light energy is emitted at the pixel in the sub-frames of the frame time 742 successive to the sub-frame 746. Thus, the sub-frame sequencing circuitry 508 concentrates the generation of light energy at the pixel at the start of the frame time 742.

In the frame time 752, the sub-frame sequencing circuitry 508 determines that the total amount of light energy to be emitted (e.g., the total amount of light energy emitted in the frame time 722) requires that some light energy be produced in each sub-frame of the frame time. The sub-frame sequencing circuitry 508 generates, at the pixel, a maximum amount of light energy that can be generated in the sub-frames 754, 756, and 758, and generates the remainder of the total amount of light energy to be produced in the sub-frame 760. Thus, the sub-frame sequencing circuitry 508 concentrates the generation of light energy at the pixel at the start of the frame time 752.

The motion management system 506 identifies bright moving areas of the images 514, and applies an anti-alias filter to the identified areas of the images 514. The motion detection circuitry 512 identifies moving areas of the images 514. For example, the motion detection circuitry 512 identifies the areas (e.g., pixels) of each image 514 that have changed location with respect to a previous image (to an immediately previous image 514).

The anti-alias filter circuitry 510 applies an anti-alias filter (i.e., a low-pass filter) to the moving areas of the images 514 identified by the motion detection circuitry 512. In some implementations, the filtering is a function of a measure of brightness and/or a measure of motion of the areas identified by the motion detection circuitry 512. For example, the amount of filtering performed (e.g., degree of high-frequency attenuation) may be a function of measured brightness and/or measured motion. In some implementations of the anti-alias filter circuitry 510, filtering is applied to areas of the image that are identified as moving by the motion detection circuitry 512 and that have a brightness exceeding a predetermined brightness threshold.

Figure 8:
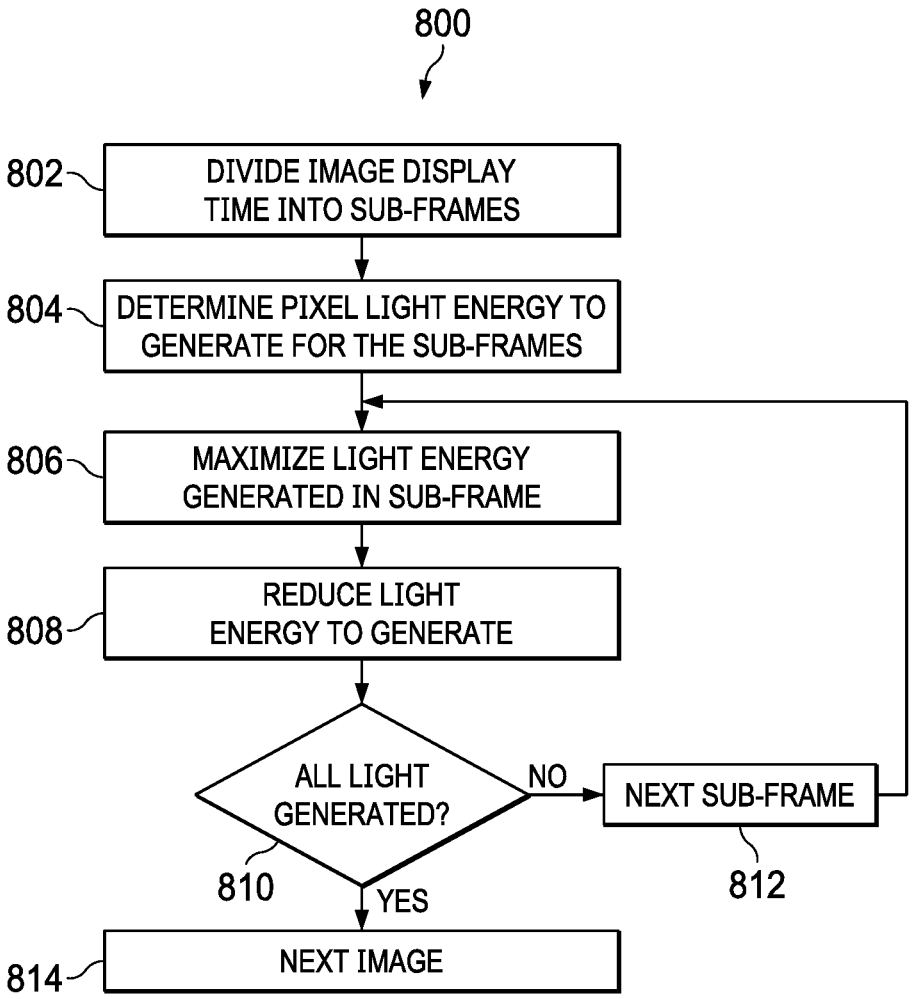
FIG. 8 shows a flow diagram for an example method for motion management used in conjunction with optical shifting to increase display resolution in accordance with this description.

FIG. 8 shows a flow diagram for an example method 800 for motion management used in conjunction with optical shifting to increase display resolution in accordance with this description. Though depicted sequentially as a matter of convenience, at least some of the actions shown can be performed in a different order and/or performed in parallel. Additionally, some implementations may perform only some of the actions shown. Operations of the 800 may be performed by implementations of the display controller 502.

Some implementations of the 800 may include the operations of the method 400 to apply alias filtering to moving areas of an image as part of the 800.

In block 802, the display controller 502 divides the time allocated to display of an image into multiple successive sub-frames. For example, in FIG. 7B, the display controller 502 divides the frame time 732 in four sub-frames.

In block 804, the display controller 502 determines the total light energy to be generated at a pixel in the time allocated to display of the image. For example, the display controller 502 determines the total light energy to be generated at a pixel in the frame time 732.

In block 806, the display controller 502 maximizes the light energy generated at the pixel in the current sub-frame. For example, in the frame time 732 all of the light energy to be generated is generatable in the sub-frame 734, and the display controller 502 generates all of the light energy at the pixel in the sub-frame 734.

In block 808, the display controller 502 determines the amount of remaining light energy to be generated at the pixel in the allocated time. For example, the display controller 502 determines the total amount of light energy to be generated less the amount of light energy generated in prior iterations of the block 806.

In block 810, the display controller 502 determines whether the total amount of light energy to be generated at the pixel has been generated. For example, in frame time 742 the display controller 502 generates light energy at the pixel in sub-frame 744 and determines that additional light energy is to be generated in the sub-frame 746.

If all of the desired light energy has not been generated, then in block 812, the display controller 502 proceeds to generate additional light in the next sub-frame of the frame time. For example, in sub-frame 746 the display controller 502 generates the remainder of the light energy to be produced in the frame time 742. If all the desired light energy has been generated, then the display controller 502 proceeds to process the next images 514 in block 814.

Modifications are possible in the described embodiments, and other embodiments are possible, within the scope of the claims.

What is claimed is:

1. A controller configured to:

divide a time interval for displaying an image into a first interval and a second interval, wherein the second interval is subsequent to the first interval;

determine, based on the image, an amount of light energy to be emitted at a pixel during the time interval;

allocate a first portion of the light energy for the pixel in the first interval;

allocate a second portion of the light energy for the pixel in the second interval based on the first portion of the light energy, wherein the first portion of the light energy is more energy than the second portion of the light energy; and in response to determining that a region of the image has a brightness magnitude greater than a brightness threshold, apply an anti-alias filter to the region.

2. The controller of claim 1, wherein the first portion comprises a maximum amount of the light energy generatable in the first interval.

3. The controller of claim 1, wherein the second portion comprises the amount of the light energy less the first portion of the light energy and up to a maximum amount of the light energy generatable in the second interval.

4. The controller of claim 1, further configured to:

divide the time interval into a third interval and a fourth interval, wherein the third interval is subsequent to the second interval, and the fourth interval is subsequent to the third interval;

allocate a third portion of the light energy for the pixel in the third interval based on the light energy generatable in the first interval and the second interval being less than the amount of light energy to be emitted at the pixel during the time interval; and allocate a fourth portion of the light energy for the pixel in the fourth interval based on the light energy generatable in the first interval, the second interval, and the third interval being less than the amount of light energy to be emitted at the pixel during the time interval.

5. The controller of claim 1, wherein the second interval is immediately subsequent the first interval.

6. The controller of claim 1, wherein the first portion comprises as much of the light energy as is generatable in the first interval.

7. The controller of claim 1, further configured to:

identify areas of the image that change location from frame to frame; and perform anti-aliasing filtering on the areas.

8. A controller configured to:

produce, based on an image, a first sub-frame and a second sub-frame spatially offset from the first sub-frame;

determine, based on the image, an amount of light energy to be emitted at a first pixel in the first sub-frame and a corresponding second pixel in the second sub-frame;

allocate at least a first portion of the amount of light energy for the first pixel in the first sub-frame; and in response to determining that the amount of light energy is greater than a maximum amount of light available at the first pixel in the first sub-frame, allocate a second portion of the amount of light energy for the second pixel in the second sub-frame based on the first portion of the light energy.

9. The controller of claim 8, wherein the first portion comprises a maximum amount of the light energy generatable in a first interval of the first sub-frame.

10. The controller of claim 8, wherein the second portion comprises the total amount of light energy to be emitted at the first pixel in the first sub-frame and at the second pixel in the second sub-frame less the first portion of the light energy and up to a maximum amount of the light energy generatable in the second pixel in the second sub-frame.

11. The controller of claim 8, further configured to:

produce a third sub-frame and a fourth sub-frame spatially offset from the first sub-frame and the second sub-frame;

determine, based on the image, an amount of light energy to be emitted at the first pixel in the first sub-frame, in the second pixel in the second sub-frame, in a corresponding third pixel in the third sub-frame, and in a corresponding fourth pixel the fourth sub-frame;

allocate a third portion of the total amount of light energy to the third pixel in the third sub-frame based on the light energy generatable in the first pixel of the first sub-frame and in the second pixel of the second sub-frame being less than the total amount of light energy to be emitted at the first pixel in the first sub-frame, at the second pixel in the second sub-frame, at the third pixel in the third sub-frame, and at the fourth pixel in the fourth sub-frame; and allocate a fourth portion of the total amount of light energy for the pixel in the fourth sub-frame based on the light energy generatable at the first pixel in the first sub-frame, at the second pixel in the second sub-frame, and at the third pixel in the third sub-frame being less than the total amount of light energy to be emitted at the first pixel in the first sub-frame, at the second pixel in the second sub-frame, at the third pixel in the third sub-frame, and at the fourth pixel in the fourth sub-frame.

12. The controller of claim 11, wherein the second sub-frame, the third sub-frame, and the fourth sub-frame are offset from the first sub-frame by a fraction of a spatial area of the first pixel.

13. The controller of claim 8, further configured to identify areas of the image that change location from frame to frame.

14. The controller of claim 8, wherein the first pixel is part of an area that is identified as changing location from frame to frame.

15. A method comprising:

dividing, by a controller, a time interval for displaying an image into a first interval and a second interval, wherein the second interval is subsequent to the first interval;

determining, based on the image, an amount of light energy to be emitted at a pixel during the time interval;

allocating a first portion of the light energy for the pixel in the first interval;

allocating a second portion of the light energy for the pixel in the second interval based on the first portion of the light energy, wherein the first portion of the light energy is more energy than the second portion of the light energy; and in response to determining that a region of the image has a brightness magnitude greater than a brightness threshold, applying an anti-alias filter to the region.

16. The method of claim 15, wherein the first portion comprises a maximum amount of the light energy generatable in the first interval.

17. The method of claim 15, wherein the second portion comprises the amount of the light energy less the first portion of the light energy and up to a maximum amount of the light energy generatable in the second interval.

18. The method of claim 15, further comprising:

dividing the time interval allocated to display of the image into a third interval and a fourth interval; wherein the third interval is immediately subsequent to the second interval, and the fourth interval is immediately subsequent to the third interval;

generating, at the pixel, a third portion of the light energy in the third interval based on the light energy generatable in the first interval and the second interval being less than the amount of light energy to be emitted at the pixel during the time interval; and generating, at the pixel, a fourth portion of the light energy in the fourth interval based on the light energy generatable in the first interval, the second interval, and the third interval being less than the amount of light energy to be emitted at the pixel during the time interval.

19. The method of claim 15, wherein the first portion comprises as much of the light energy as is generatable in the first interval.

20. The method of claim 15, further comprising:

identifying areas of the image that change location from frame to frame; and performing anti-aliasing filtering on the areas.

* * * * *